United States Patent [19]

Rivere

[11] 3,935,853

[45] Feb. 3, 1976

[54] INTERNAL COMBUSTION ENGINE COLD-START FUEL INJECTOR

[75] Inventor: Jean-Pierre Rivere, Boulogne-Billancourt, France

[73] Assignees: Regie Nationale des Usines Renault, Boulogne-Billancourt; Automobiles Peugeot, Paris, both of France

[22] Filed: July 23, 1974

[21] Appl. No.: 491,000

[30] Foreign Application Priority Data

Sept. 11, 1973 France ..... 73.32663

[52] U.S. Cl.... 123/179 G; 123/179 L; 123/187.5 R

[51] Int. Cl.[2]..... F22b 7/14

[58] Field of Search ..... 123/179 R, 179 G, 179 L, 123/187.5 R, 180 E, 180 P, 139 E, 32 JV, 32 AE, 33 J; 251/54, 44, 45, 46; 239/585

[56] References Cited

UNITED STATES PATENTS

| | | | |
|---|---|---|---|
| 1,754,740 | 4/1930 | Clarkson | 239/585 |
| 3,311,102 | 3/1967 | Voigt | 123/179 L |
| 3,315,701 | 4/1967 | Stilwell | 251/54 |
| 3,753,426 | 8/1973 | Lilley | 123/139 E |
| 3,796,205 | 3/1974 | Links et al. | 128/139 E |
| 3,839,943 | 10/1974 | Ufnalewski | 123/139 E X |

FOREIGN PATENTS OR APPLICATIONS

| | | | |
|---|---|---|---|
| 969,825 | 9/1964 | United Kingdom | 251/54 |

*Primary Examiner*—Wendell E. Burns
*Assistant Examiner*—James D. Liles
*Attorney, Agent, or Firm*—Fleit & Jacobson

[57] ABSTRACT

This cold-start injector for internal combustion engines is adapted to be connected to the induction manifold of the engine and comprises essentially a normally closed needle valve controlling the delivery of fuel and a solenoid for actuating said needle valve adapted to be inserted in series with the manual switch controlling the starter motor of the engine. Said needle valve or other movable member of the solenoid bears through a spring against a fluid-type damping capacity comprising a pair of movable walls and, between said walls, a fixed partition having a throttling orifice, said spring reacting against one of said movable walls, the other wall co-acting with the movable member of a normally closed electric switch disposed in series in said circuit and adapted to be opened by means of said damping capacity.

6 Claims, 2 Drawing Figures

INTERNAL COMBUSTION ENGINE COLD-START FUEL INJECTOR

The present invention relates to cold-start fuel injectors for petrol internal combustion engines, these injectors being intended more particularly but not exclusively for so-called injection engines wherein the fuel injection takes place upstream of the valves. An injector of this type, adapted to be connected to the induction manifold, comprises notably a normally closed needle valve controlling the delivery of petrol and a solenoid for actuating said needle valve to open same, said solenoid being adapted to be connected in series with the electric switch controlling the electric starter motor of the engine.

The present invention is concerned with a specific arrangement of a fuel injection device of this character which prevents in a particularly simple and economical manner the "flooding" of the engine with fuel when starting the engine, especially in the cold state. Basically, this invention is characterised in that the needle valve, the movable core means of the solenoid, reacts through spring means against a fluid-type damping capacity comprising two relatively movable walls and between these walls a fixed partition comprising a throttling orifice, said spring means engaging one of said movable walls, the other movable wall co-acting with the movable member of a normally closed or back contact inserted in series in the aforesaid circuit and adapted to be opened through the medium of said damping capacity.

Under these conditions it is convenient and advantageous to use a damping fluid of which the viscosity varies very considerably with the injector temperature, so that the higher the injector temperature, the shorter the operating time thereof; therefore, this fluid should have a viscosity decreasing with temperature. Moreover, by providing for said normally closed or back contact means for shifting the closing in relation to the opening thereof, the risk of flooding the engine can be further reduced as well as the abnormally frequent and prolonged energizations of the starter motor, notably by inserting said back contact also in series with the starter motor relay solenoid.

Thus, the electric delay-action thermal switch usually employed in fuel injection systems and the electric wiring necessary therefor can be dispensed with, while affording a simplified mounting and installation of the fuel injector proper.

Figure 1:
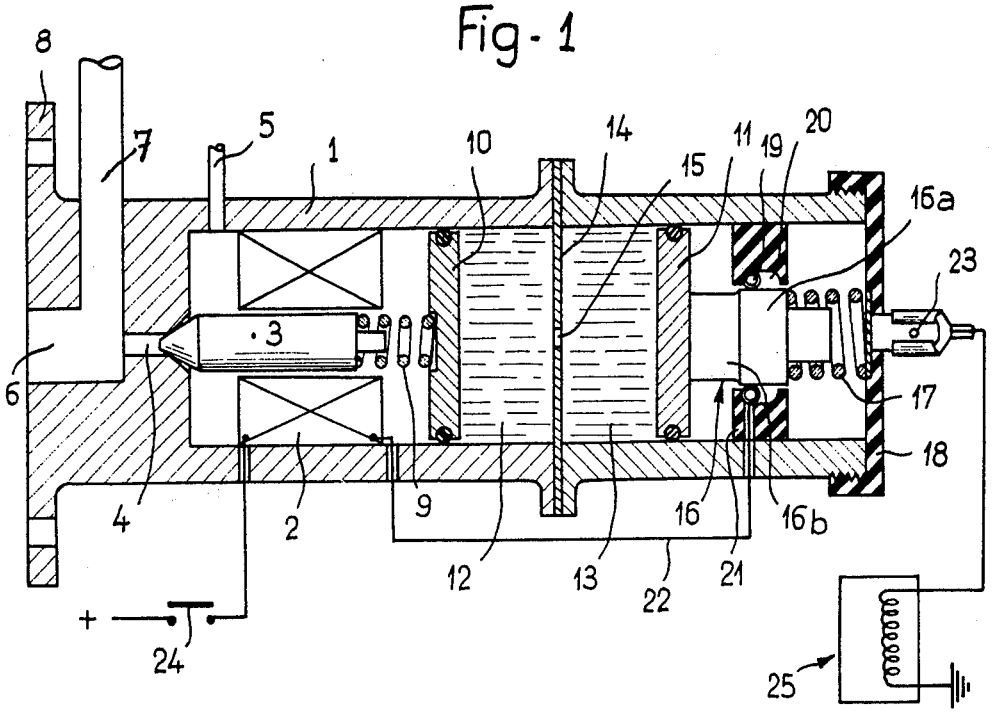
Figure 2:
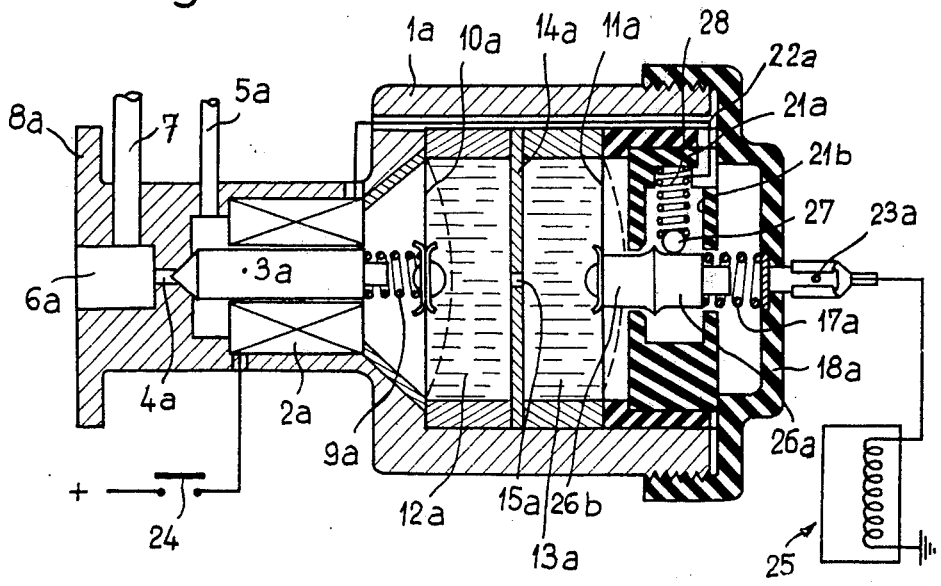

Two typical forms of embodiment of the present invention will now be described by way of example with reference to the attached drawings, in which:

FIG. 1 is a diagrammatical axial section of a fuel injector according to this invention, and FIG. 2 is a similar view showing a modified form of embodiment of a fuel injector.

The injector illustrated in FIG. 1 comprises a body 1 enclosing a solenoid 2 of which the movable core constitutes a needle valve 3 adapted to be seated in an orifice 4 controlling the delivery of petrol fed to the input chamber of the solenoid via an inlet pipe 5 or hose 5. Opening into the outlet pipe 6 of the fuel injector which is disposed downstream of the aforesaid orifice 4 is an air input passage 7 adapted in this case to produce a preliminary emulsion of the air-fuel mixture to be delivered by the injector into the engine induction manifold to which it is adapted to be connected by means of a flange 8.

The needle valve 3 is normally seated by a return spring 9 reacting against the movable wall 10 of a fluid-type damping capacity formed in said body 1 and comprising, between said wall 10 and another movable wall 11, a pair of chambers 12 and 13 separated by a fixed partition 14 in which a throttling orifice 15 is formed.

The second movable wall 11 is adapted to co-act with the movable member 16 of an electric switch comprising a conducting element **16*a* and an insulating element 16*b*, said movable member 16 being normally urged against said movable wall 11 by a coil compression spring 17 reacting against an insulating end cap 18 engaging a screw-threaded end portion of said body 1. Co-acting with the movable electric member 16 is an annular coil spring 19 fitted in a groove 20 formed in an insulating ring 21 mounted in a fixed position in said body 1. This annular coil spring 19 is electrically connected at one point of ring 21 to a conductor 22 connected in turn to one terminal of solenoid 2. The annular coil spring 19 is fitted somewhat tightly on the movable member 16 so that when the conducting portion 16*a* of this member 16 is moved to the right as seen in FIG. 1 the spring 19 tends to be wound on itself and to move bodily with said portion 16*a* in the groove 20 formed to this end with an axial extension, as shown. Through the coil compression spring 17 the conducting portion 16*a* of member 16 is connected to a connector 23 secured to the end cap 18 and inserted in the starter motor control circuit having its manual control switch 24 connected to the second terminal of solenoid 2; thus, this contact 24, the solenoid winding 2 and the electric contact or switch 16–19** are disposed in series.

This cold-start fuel injector operates as follows:

When the starter-motor control switch 24 is closed, the solenoid 2 is energized and simultaneously the starter motor is energized and the needle valve 3 opens the passage 4 permitting the delivery of fuel, while the spring 9 transmits its corresponding compression effort to the first movable wall 10 of the damping capacity. The liquid forced from chamber 12 to chamber 13 forces the other movable wall 11 to the right, together with the movable member 16 driving firstly therewith on its larger portion **16*a* the annular coil spring 19 to the right-hand end of groove 20. Then, the annular coil spring 19 and the enlarged portion 16*a* of member 16 are suddenly separated from each other, the spring 19 resuming its initial position, this return movement being facilitated by the fact that the diameter of the insulating portion 16*b* of member 16 is smaller than that of portion 16*a*. As a consequence of the breaking of the electric contact between coil 19 and portion 16*a*, the solenoid 2 is de-energized, whereby the needle valve 3 is seated immediately by the force of return spring 9, even if the driver kept the manual switch 24 closed. The electric contact between spring 19 and portion 16*a* of member 16 is subsequently restored only when, as a consequence of the force of spring 17, the movable member 16 and the movable walls 10 and 11 are allowed to resume their initial positions. This arrangement is particularly advantageous in that it avoids any flooding of the engine by preventing an excess fuel injection in case the engine did not start for any reason. Moreover, by connecting the connector 23 to the solenoid of relay 25 controlling the engine starter motor, the engine is prevented from being driven until contact 19–16*a*** is restored, thus enabling the already injected fuel to be partially vaporized, and therefore automatically preventing an undue electric current demand from the storage battery of the vehicle.

FIG. 2 illustrates a modified form of embodiment wherein the injection system differs from the preceding one only through the use of membranes for constituting the damping capacity and the use of different means for off-setting the closing of the internal electric switch in relation to the opening thereof.

Otherwise, the similar component elements of the injectors are designated by the same reference numerals as those used in FIG. 1, plus the index "*a*", including the membranes designated by symbols 10*a* and 11*a*, respectively.

The membrane 11*a* co-acts with the movable member 26 of an electric switch comprising a conducting portion 26*a* and an insulating portion 26*b* of which the junction acts as a cam means co-acting in turn with a ball 27 (or a round-tipped stud) radially urged against this cam by a coil compression spring 28 housed in a cavity 21*b* formed in an insulating ring 21*a*. This cavity 21*b* affords a certain axial movement of the ball 27, this movement being attended by a certain yielding of spring 28. This spring 28 is connected via a conductor 22*a* to one terminal of the solenoid and the conducting portion 26*a*, as in the preceding form of embodiment, is connected via an axial coil compression spring 17*a* to a connector 23*a*, this assembly forming a series circuit with the manual switch 24 and the starter motor solenoid control relay 25.

Since the operation is exactly the same as in the preceding case, it is not deemed necessary to describe it in detail, for it is clear that the junction of the conducting and insulating portions 26*a* and 26*b*, respectively, constitutes the apex of the cam consisting of said member 26; as a result, a predetermined axial movement of this member 26 to the right from the position shown in FIG. 2 will be necessary to cause the ball 27 to engage the insulating portion 26*b* and open the control circuit, while a predetermined axial movement in the reverse direction will be required subsequently to cause the ball 27 to clear the aforesaid apex and resume its position on the conducting portion 26*a* to restore the control circuit.

Of course, other modifications may be contemplated when embodying this device without departing from the basic principles of the present invention, as will appear to those conversant with the art.

What is claimed as new is:

1. In combination with an internal combustion engine having a fuel flow passage and an electrical control circuit for a starter motor, said circuit being connected to an associated source of electrical power and including a manual control switch, a cold-start fuel injector comprising: a housing; a normally closed needle valve associated with the fuel flow passage for controlling the delivery of fuel to said engine; a solenoid on said housing for actuating said needle valve in an opening direction inserted in electrical series with the manual control switch in said control circuit; a fluid-type damping means having a pair of movable end walls defining a chamber and having a fluid in said chamber and a partition located in said chamber and fixed to said housing, said partition having therein a throttling orifice; a spring interposed between one of said pair of movable end walls and said needle valve to bias said needle valve in a closing position; normally closed contact means associated with the other of said movable end walls and inserted in electrical series with said solenoid in said control circuit, said normally closed contact means including a movable member for opening and closing said contact means, said movable member being mounted on the other one of said movable end walls for movement therewith, said normally closed contact means being biased in an opening direction via said fluid-type damping means when said needle valve is actuated in said opening direction.

2. Injector as set forth in claim 1, wherein the viscosity of said damping fluid decreases with increasing temperature.

3. The cold-start fuel injector of claim 1 wherein said normally closed contact means is adapted to occupy opened and closed positions, said damping means being arranged to maintain said normally closed contact means in said open position until said needle valve is returned to said closed position whereby said needle valve is reset in the fuel flow passage before said normally closed contact means reoccupies said closed position.

4. The cold-start injector of claim 1 wherein the starter motor control circuit includes a starter motor control relay and wherein said normally closed contact means is connected in series with the starter-motor relay.

5. Injector as set forth in claim 3, wherein said normally closed contact means comprises a pair of coupled rings including a conducting ring and a non-conducting ring, both of said rings adapted to move axially, a fixed ring, and a coil contact spring forming an annular coil surrounding said rings and mounted in a groove of said fixed ring and adapted to move freely in the axial direction of said normally closed contact means to a predetermined extent, whereby said annular spring normally tends to follow in said groove said conducting portion before breaking the contact and shifting to said non-conducting ring.

6. Injector as set forth in claim 3, wherein said normally closed contact means comprises a pair of axially displaceable coupled rings including a conducting ring and a non-conducting ring a cam means formed at the junction of said rings, a contact member engaging said cam means, a spring means biasing said contact member inwardly against said rings a companion spring attached to said contact member to allow movement of said contact means in the axial direction of said normally closed contact means, whereby said movable member is adapted to follow the movement of said cam means before moving from contacting the conducting ring to contacting the non-conducting ring, and vice-versa.

* * * * *